United States Patent [19]

Carballo

[11] Patent Number: 5,012,610

[45] Date of Patent: May 7, 1991

[54] EMERGENCY ESCAPE FRAME FOR BUILDING APERTURES

[76] Inventor: Jose Carballo, 3141 SW. 20 St., Miami, Fla. 33145

[21] Appl. No.: 547,555

[22] Filed: Jul. 3, 1990

[51] Int. Cl.[5] ..... E06B 3/68; E05B 65/10

[52] U.S. Cl. ..... 49/57; 49/51; 49/141; 49/379; 49/395

[58] Field of Search ..... 49/141, 395, 51, 379, 49/57

[56] References Cited

U.S. PATENT DOCUMENTS

| | | | |
|---|---|---|---|
| 2,787,348 | 4/1957 | Goodemote et al. | 49/141 |
| 3,120,032 | 2/1964 | Burnette | 49/141 X |
| 4,237,654 | 12/1980 | Landem et al. | 49/141 |
| 4,263,747 | 4/1981 | Coltrin et al. | 49/141 X |
| 4,445,589 | 5/1984 | Longenecker | 49/141 X |
| 4,452,010 | 6/1984 | Whittington et al. | 49/51 |
| 4,679,365 | 7/1987 | Herring | 49/141 X |
| 4,771,574 | 9/1988 | Stephens | 49/141 |
| 4,841,673 | 6/1989 | Tjomsland | 49/141 |

*Primary Examiner*—Philip C. Kannan
*Attorney, Agent, or Firm*—J. Sanchelima

[57] ABSTRACT

An removable frame assembly for building apertures that can be readily pushed out by a user in an emergency situations. It includes a fixed frame rigidly mounted to the aperture and a second frame removably mounted to the fixed frame. The removable frame rigidly houses the window for the aperture and, optionally, security bars to prevent trespassers from entering through the window. The security bars can be installed inside or outside the building. A relatively remotely located locking mechanism releasably keeps the fixed and removable frames together. A spring member sandwiched between the fixed and removable frame members urge the separation of the two when the locking mechanism releases them.

8 Claims, 4 Drawing Sheets

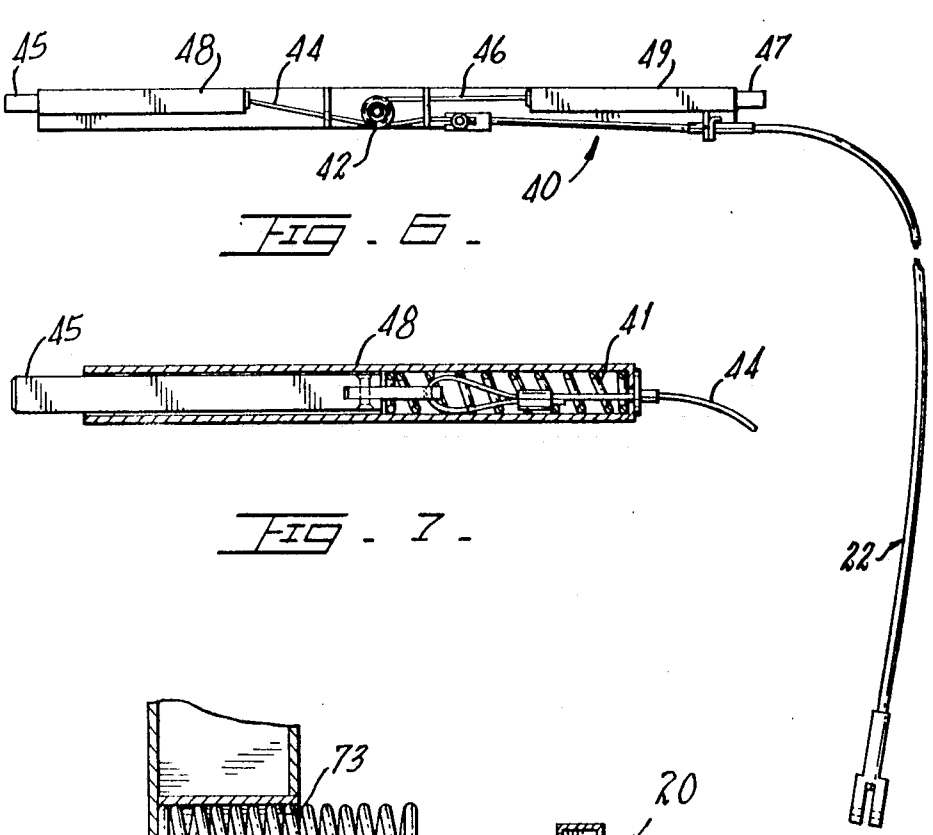
FIG. 6.
FIG. 7.
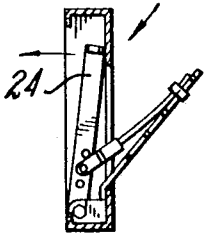
FIG. 9.
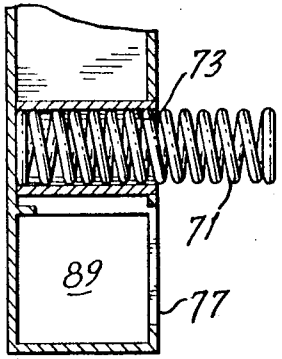
FIG. 8.
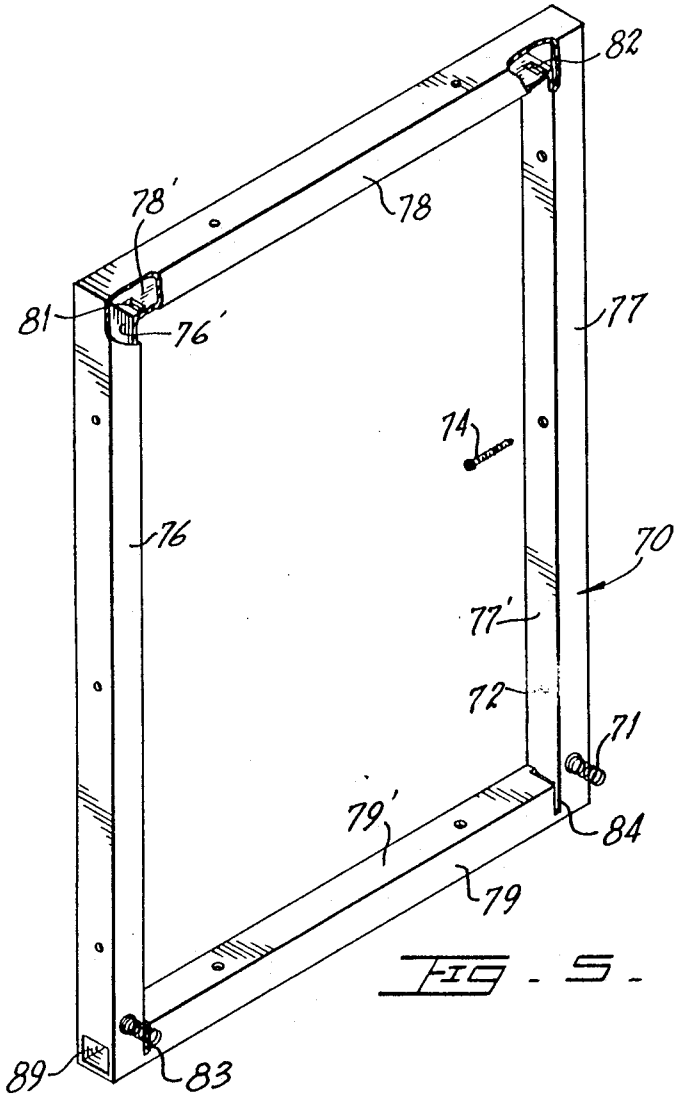
FIG. 5.

EMERGENCY ESCAPE FRAME FOR BUILDING APERTURES

BACKGROUND OF THE INVENTION

1. Field of the Invention

The present invention relates to emergency escape frames for building apertures, and more particularly, to such frames that are readily removable by a user.

2. Description of the Related Art

The need for security has forced an increasing number of dwellers and building owners to install security windows and even iron bars covering the building apertures, such as windows. Not infrequently, however, when there is an emergency that requires the evacuation of the building these very same security devices become a death trap for those persons inside the building. In only a few minutes they can be overcome by smoke and suffocated. Thence the need of an apparatus that will permit a person to readily remove the security iron bars protecting an aperture without compromising its effectiveness for security purposes.

Applicant believes that the closet reference corresponds to U.S. Pat. No. 3,120,032 issued to R. W. Burnette. However, it differs from the present invention because it does not concern itself with the escape safety features claimed in the present invention, including, the capability of this invention's apparatus to permit the compatible installation of windows and security bars while readily releasing same in case of an emergency. Another reference that may be relevant to establish the prior art is U.S. Pat. No. 4,841,673 issued to Tjomsland with respect to the positioning of a remote mechanism for releasing the lock. The rigid rod used, however, limits the flexibility on where to placed this mechanism. The security window system structure is different and requires the use of special hingedly mounted windows and it would not work with louver type windows.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a collapsible or removable frame for building apertures that can be readily actuated from inside a building and that permits the removal of the entire window, including security iron bars, if any.

It is another object of this present invention to provide such a frame that does not compromise the effectiveness of the doors, windows or security iron bars installed.

It is another object of this invention to provide a removable frame assembly that is compatible with most commercially available windows.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 5 shows the fixed frame with two partial cross-sections on the upper corners to show the two upper slots where the tabs of the removable frame are inserted and the springs urging the removable frame outwardly.

FIG. 6 represents the locking mechanism utilized in one of the preferred embodiments to secure the removable frame to the fixed frame.

FIG. 7 is a cross-sectional view of the spring loaded locking bolt used in the locking mechanism shown in FIG. 6.

FIG. 8 is a partial cross-section of the lower part of the fixed frame showing the spring member used to urge the removable frame outwardly and the opening where it is housed.

FIG. 9 represents a partial cross-sectional view of the actuator mechanism utilized in one of the preferred embodiments.

DETAILED DESCRIPTION OF THE PREFERRED EMBODIMENT

Figure 1:
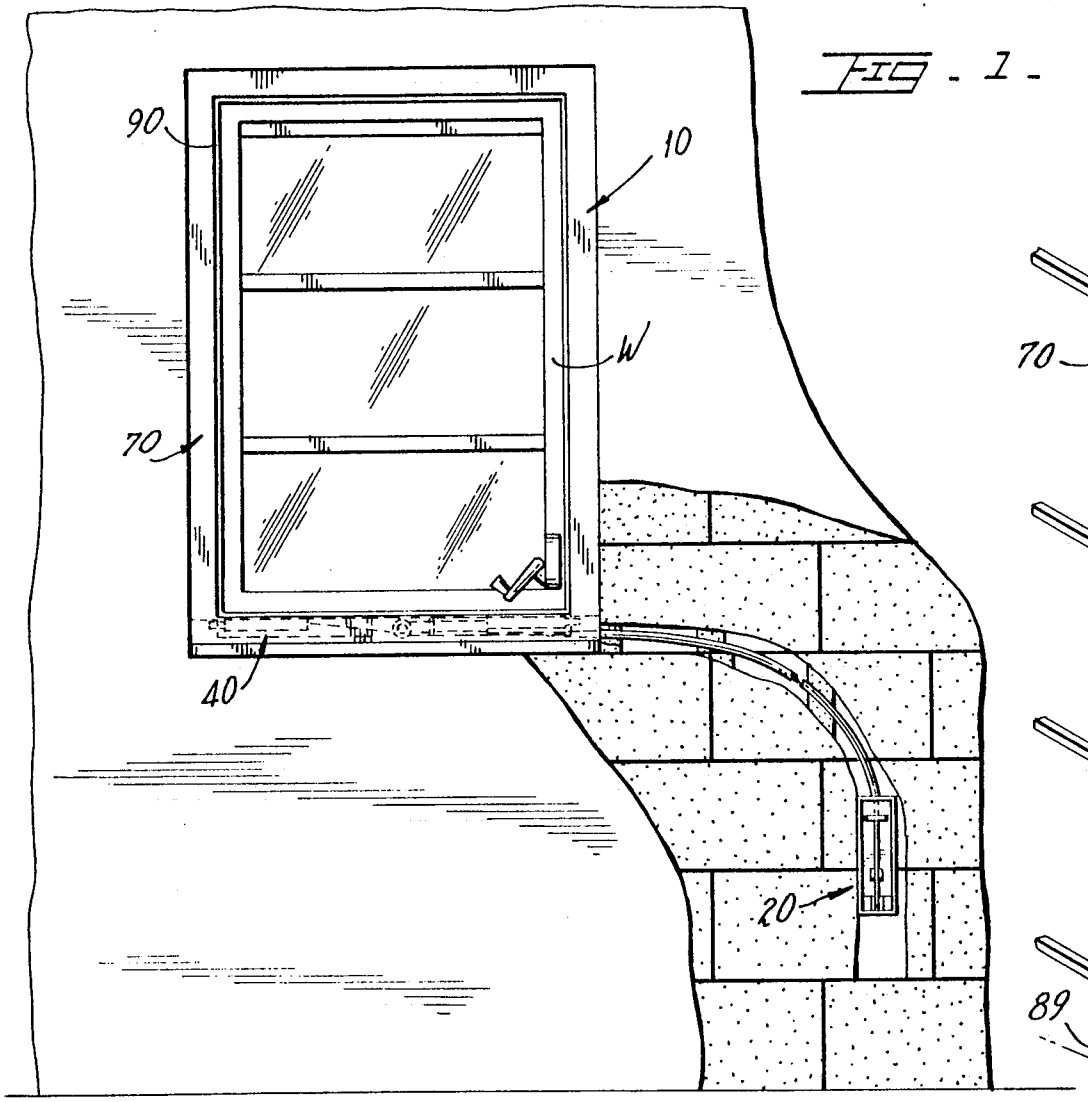
FIG. 1 represents the present invention installed in a window as seen from inside a building.

Referring now to FIG. 1, where the present invention is generally referred to with numeral 10, it can be observed that it basically includes an actuator assembly 20 that actuates locking assembly 40 to release the engagement of fixed frame 70 to removable frame 90. Window frame W is rigidly mounted to removable frame 90.

Figure 2:
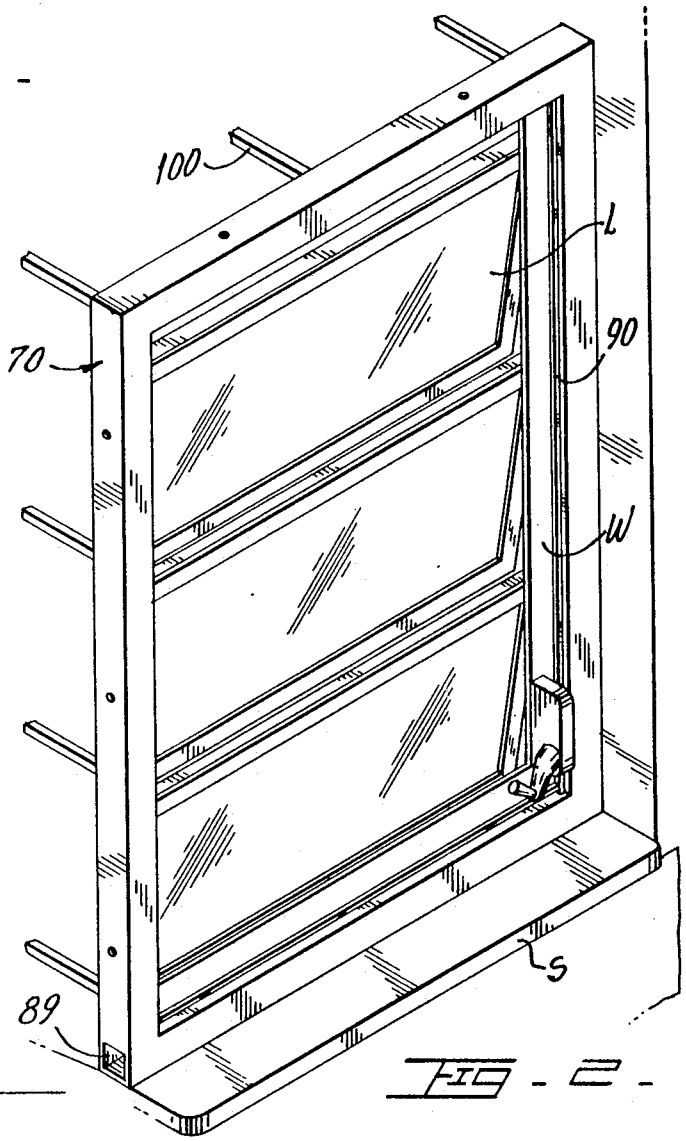
FIG. 2 shows an isometric view of the fixed frame assembly housing a conventional window frame of the louver type that in turn is mounted to the removable frame and a partial representation of iron bars installed on the removable frame assembly.

FIG. 2 illustrates the mounting of a typical louver type window frame W to removable frame 90 and security iron bars 100 that are rigidly mounted to removable frame 90. The optional iron bars, in this figure, are shown to extend outwardly from the building structure.

Figure 3:
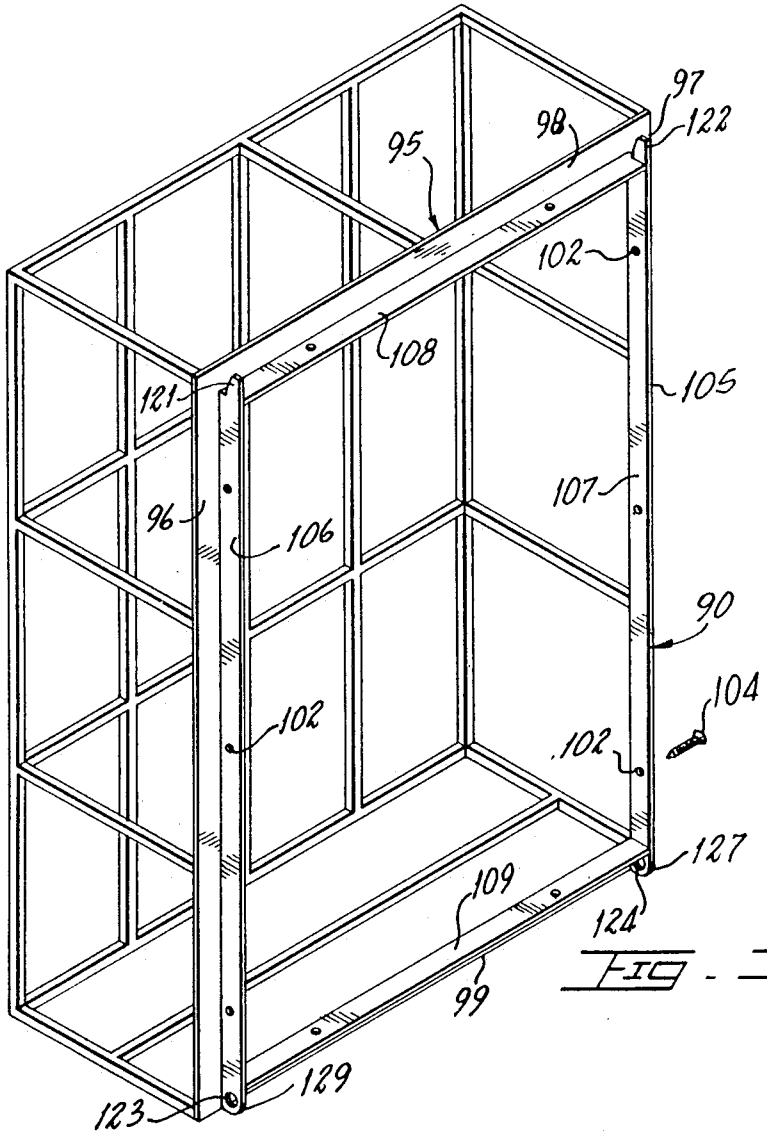
FIG. 3 illustrates an isometric view of the removable frame with the optional iron bars.

A representation of removable frame 90 with optional security iron bars rigidly mounted thereon is shown in FIG. 3. Removable frame assembly 90 includes flat elongated members 96; 97; 98 and 99 that form a first rectangular frame member 95. A second rectangular frame member is formed with elongated flat members 106; 107; 108 and 109 and these members are mounted substantially adjacent to the internal periphery of the first frame member. Further, member 106; 107; 108 and 109 are disposed perpendicularly with respect to members 96; 97; 98 and 99. Several through holes 102 are provided to permit screws 104 through and to rigidly mount window frame W within the second rectangular frame, as shown in FIG. 2. Second rectangular frame 105 includes, at its upper corners, tabs 121 and 122. At its lower corners, members 106 and 107 terminate with a short protrusions 127 and 129 including openings 123 and 124.

Figure 4:
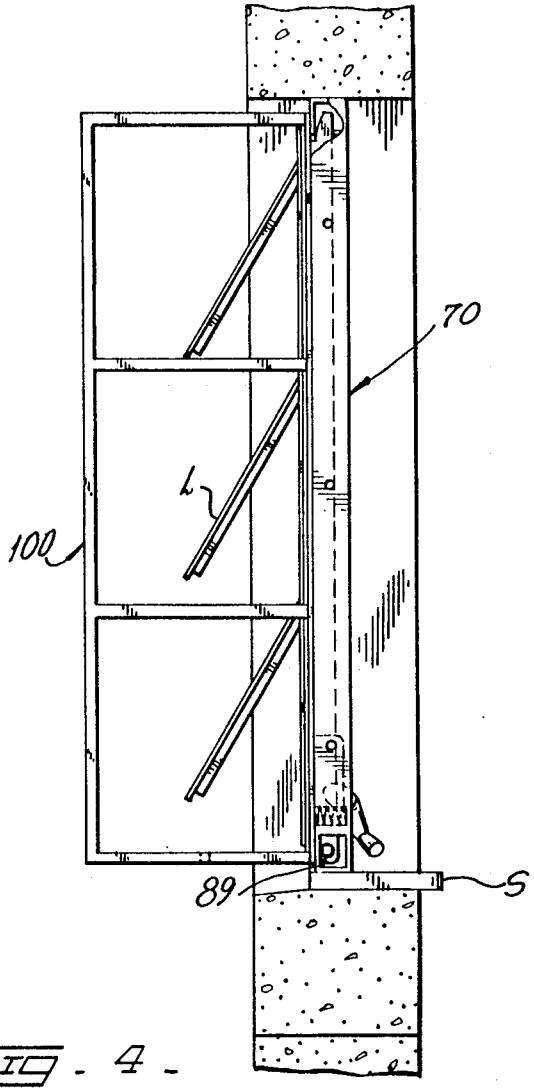
FIG. 4 is a representation of a side view of the removable frame including the optional iron bars, the fixed frame and the louver type window along with a partial cross section of the wall where the removable and window frames are installed.

Security bars 100 are shown in FIG. 3 to extend outwardly from the outer surface of the first rectangular frame. Iron bars 100 are preferably soldered to the outer surface of the first frame. In FIG. 4 it can be observed that bars 100 form a cage with sufficient separation to permit the opening and closing of louvers L. It is also possible to have bars 100' mounted inside, in FIGS. 10 and 11. In this alternative embodiment, bars 100' are soldered on the outer edge of members 106'; 107'; 108' and 109' that form second rectangular member 105'.

FIG. 5 shows fixed frame assembly 70 which is basically, in the preferred embodiment, a rectangular frame. Depending on the building aperture, the shape and dimensions of fixed frame assembly 70 will vary. Fixed frame assembly includes two vertical hollow members 76 and 77 and two horizontal hollow members 78 and 79, forming a rectangular frame. In the preferred embodiment, members 76; 77; 78 and 79 have a rectangular cross-section with internal walls designated as 76'; 77'; 78' and 79'. Fixed frame assembly 70 includes a number of through holes 72 that permit the use of fastening devices 74 to securely mount it against the building wall. At the two upper corners, there are two slots 81 and 82 on wall member 78'. At the two lower corners, there are two additional slots 83 and 84 that receive the lower terminations of members 106 and 107 that include openings 123 and 124. Slots 81 and 82 cooperatively receive tabs 121 and 122 of removable frame assembly 90.

The locking mechanism is generally represented with numeral 40 and is connected to actuating assembly 20, as generally seen in FIG. 1, and more particularly in FIG. 6. The latter transmits the pulling force provided by a user through steel wire 22 which in turn causes pulley 42 to rotate wounding steel wires 44 and 46. In FIG. 7, locking bolt cylinder 48 is shown wherein wire 44 is attached to bolt member 45. Spring member 41 loads bolt member 45 urging it outwardly when no pulling force is applied. The pulling force transmitted by the user overcomes spring 41 causing bolt member 45 to retract inside cylinder 48. Cylinder 49 and bolt member 47 function in a similar fashion. Bolt members 45 and 47 penetrate through openings 123' and 124' thereby locking removable frame member 90 in place with respect to fix frame member 70. Locking mechanism 40 is introduced through longitudinal opening 89 above window sill S.

In FIG. 8 is a partial cross-sectional view of the lower corner of fixed frame assembly 70 showing cavity 73 and spring member 71 housed therein. The purpose of spring member 71 is to aid a user in pushing out removable frame 90 once locking mechanism 40 has released it. In FIG. 9, a side view of actuator assembly 20 is shown with handle member 24. Actuator assembly 20 is preferably mounted at a distance sufficiently separated from the window aperture being protected so that an intruder cannot reach it and operate from outside the building structure.

Figure 11:
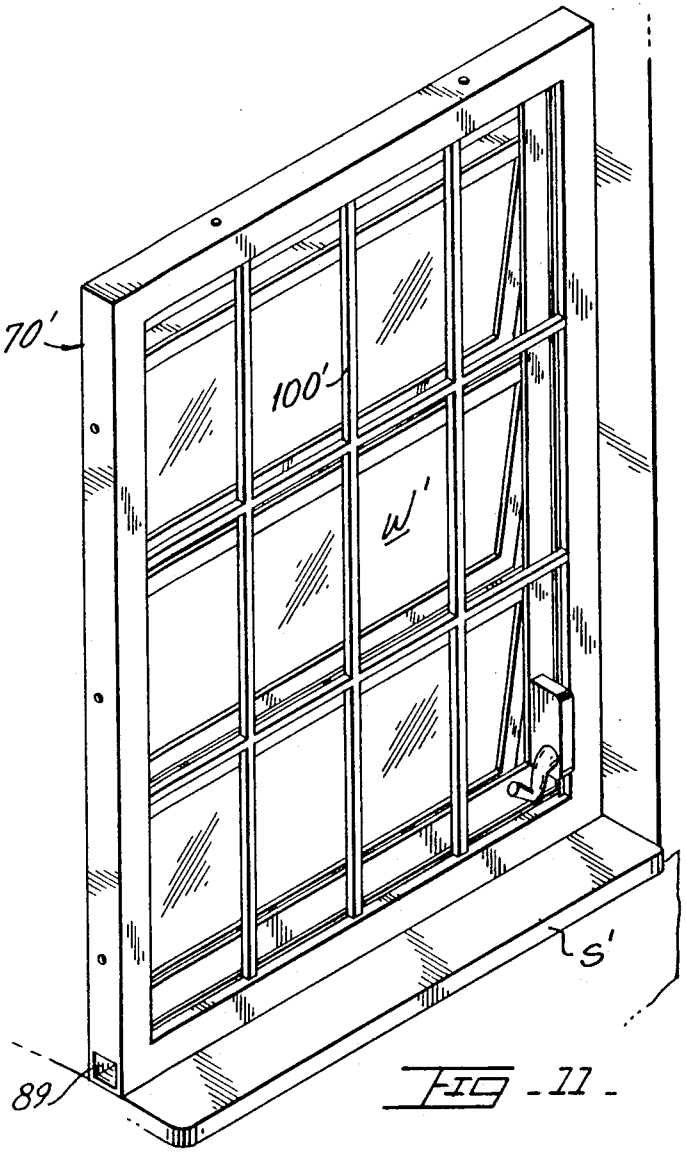
FIG. 11 shows the installation of the present invention, with the internal security bars, within a fixed frame.
Figure 10:
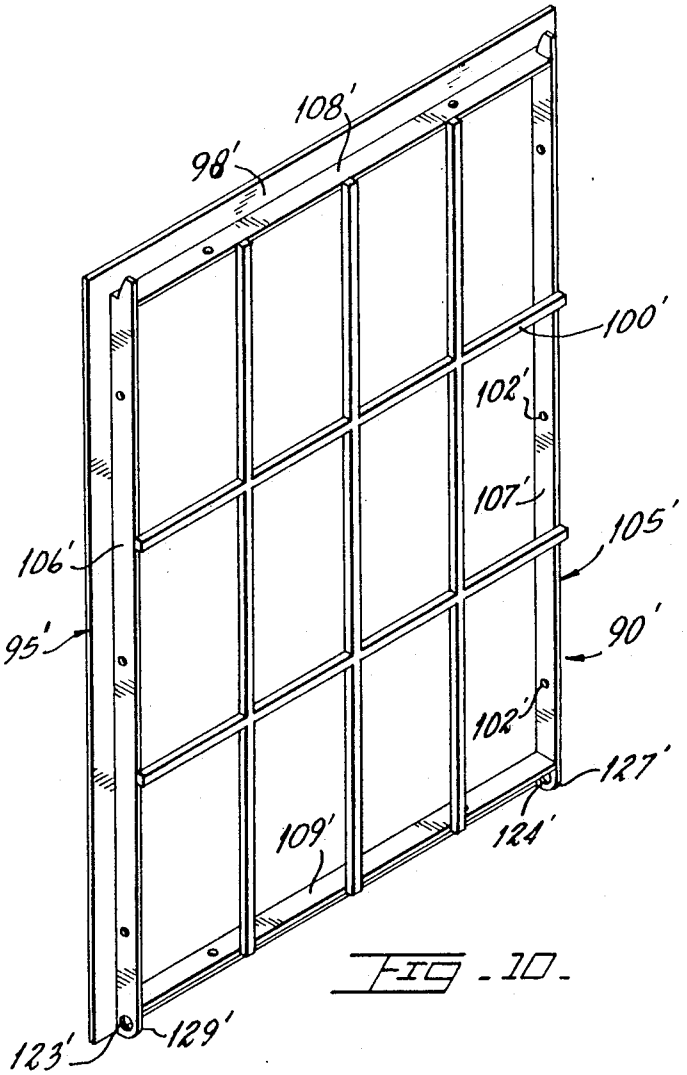
FIG. 10 illustrates an alternate embodiment for the incorporation of the security bars from inside.

In FIGS. 10 and 11, an alternate embodiment for the installation of security bars 100' is shown where they are installed inside the building. As it can be seen, removable frame assembly 90' also includes first frame member 95' and second frame member 105', perpendicularly disposed with respect to each other and with terminations 127' and 129' that include openings 123' and 124'. Security bars 100' are preferably soldered (rigidly mounted) to the edges of the elongated flat members 106'; 107'; 108' and 109' that jointly form second frame member 105'. There is no interference with the operation of window W' which is mounted to removable frame assembly 90'. Similarly, removable frame assembly 90' is removably mounted to fixed frame assembly 70'. Through opening 89 permits locking mechanism 40 to be inserted therethrough and above sill S.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A frame assembly for building apertures where a window is to be installed, comprising:

A. fixed frame means rigidly mounted in said apertures;

B. removable frame means removably mounted to said fixed frame means and having sufficiently large dimensions to cooperatively and rigidly house said window and said removable frame means further includes security bar means to prevent the entry of strangers through said window;

C. means for releasably locking said removable frame means to said fixed frame means; and D. means for actuating said locking means.

2. The frame assembly set forth in claim 1 wherein said fixed frame means includes spring means for urging the separation of said removable frame means from said fixed frame means.

3. The frame assembly set forth in claim 2 wherein said removable frame means has a substantially rectangular shape with an upper side and a lower side and further including at least one tab member on said upper side and said lower side includes at least one termination with a through opening thereon, and said fixed frame means having upper and lower sides with cooperating slots for receiving said tab members and said terminations, and wherein said terminations cooperate with said means for releasably locking said removable frame means to said fixed frame means.

4. The frame assembly set forth in claim 3 wherein said means for releasably locking said removable frame means to said fixed frame means includes spring loaded bolt members cooperatively engaging said through opening in said terminations.

5. The frame assembly set forth in claim 4 wherein means for actuating said locking means includes steel wire means for transmitting a user's force and thereby permitting said means for actuating said locking means to be mounted at a relatively remote distance from said aperture.

6. The frame assembly set forth in claim 5 wherein said removable frame means includes first and second rectangular frame members, and said first rectangular member having four elongated flat members joined to each other defining an inner edge and said second rectangular frame member also having four elongated flat members that are perpendicularly disposed with respect to the elongated flat members of said first rectangular frame member and positioned substantially at said inner edge.

7. The frame assembly set forth in claim 6 wherein said security bars are rigidly mounted to said first rectangular member forming a cage with sufficiently large dimensions to permit the operation of said window.

8. The frame assembly set forth in claim 6 wherein said security bars are rigidly mounted to said second frame member.

* * * * *